United States Patent [19]

Rizza

[11] Patent Number: 4,799,345

[45] Date of Patent: Jan. 24, 1989

[54] REVERSIBLE COMPRESSION SEAL

[76] Inventor: Michael C. Rizza, 2863 Encina Camino, Walnut Creek, Calif. 94598

[21] Appl. No.: 109,966

[22] Filed: Oct. 19, 1987

[51] Int. Cl.[4] ..... E04C 11/10

[52] U.S. Cl. ..... 52/396; 52/403; 404/65; 404/66

[58] Field of Search ..... 52/403, 396; 404/64, 404/65, 66

[56] References Cited

U.S. PATENT DOCUMENTS

| | | | |
|---|---|---|---|
| 3,286,425 | 11/1966 | Brown . | |
| 3,485,149 | 12/1969 | Boney . | |
| 3,517,472 | 6/1970 | Toth | 52/403 |
| 3,608,442 | 9/1971 | Berchou | 404/65 |
| 3,682,053 | 8/1972 | Kerschner | 404/65 |
| 3,881,834 | 5/1975 | Bowman | 404/64 |
| 4,271,650 | 6/1981 | Lynn-Jones | 52/403 |
| 4,351,622 | 9/1982 | Kerchner | 52/396 |
| 4,362,428 | 12/1982 | Kerschner . | |
| 4,616,460 | 10/1986 | Nicholas . | |
| 4,625,485 | 12/1986 | Nicholas . | |

FOREIGN PATENT DOCUMENTS

| | | | |
|---|---|---|---|
| 974110 | 9/1975 | Canada | 52/396 |

*Primary Examiner*—Henry E. Raduazo

*Attorney, Agent, or Firm*—Townsend and Townsend

[57] ABSTRACT

A seal for sealing the region between abutting building surfaces is provided with a first surface for presentation when the seal is used between smooth abutting wall surfaces, and a second surface for presentation where one or both of the abutting wall surfaces is rough. The seal's position between abutting building surfaces is reversible so as to present either the first or second surface, depending on the nature of the abutting building surfaces. Side sections are provided with ridges and grooves for receiving sealant material to form a barrier between the exterior region and interior region of the area between abutting building surfaces and to provide adhesion between the seal and the building surfaces to assure the seal is maintained against the abutting building surfaces upon expansion or contraction of the area between those surfaces.

12 Claims, 2 Drawing Sheets

REVERSIBLE COMPRESSION SEAL

BACKGROUND OF THE INVENTION

1. Field of the Invention

The present invention relates generally to building seal devices, and more particularly to an improved compression seal used to protect areas between abutting building surfaces from moisture and foreign material, which allows independent movement of each building surface and which may be used when one or both of the abutting building surfaces are either smooth or rough.

2. Description of the Relevant Art

Seals fitting between abutting building surfaces for sealing the region between those surfaces from moisture, dirt, etc., have been known for some time. Typically, when large structures are constructed, allowance for expansion and contraction of the building materials due to thermal variation and motion of the structure due to seismic activity and climatic conditions (e.g., wind) must be made. A common method for making such allowance is to construct the structure leaving gaps, called joints, in sections of the structure. In this method, discrete sections of the structure are left free to move independently of one another so as to distribute any expansion or contraction of the building material or other motion due to seismic activity, climatic conditions, or the like.

When joints are provided in the structure, steps must be taken to isolate the internal environment of the structure from the external environment. It is especially important to seal the internal environment from water, dirt, and other foreign material which may affect heating, ventilation, electrical interconnection, interior fixtures, cause undue wear between the building surfaces, and the like. A requirement of any seal used in such cases is that it be capable of accommodating motion of the structure while maintaining its imperviousness to the elements.

An example of such a seal is shown in U.S. Pat. No. 3,286,425, issued to Brown, dated Nov. 22, 1966, showing a seal which fits securely into a specially shaped region between abutting building surfaces. Also showing such seals are the patents to Nicholas, U.S. Pat. Nos. 4,616,460, dated Oct. 14, 1986, and 4,625,485, dated Dec. 2, 1986. The patents to Nicholas show two seals which fit into frame members located in abutting building surfaces. It should be noted that in each of the above-mentioned references, the seals fit into regions specifically designed to receive them. In contrast to this, U.S. Pat. No. 4,030,852, dated June 21, 1977, issued to Hein, shows a seal which may be fitted into a region between abutting building surfaces, without the need for means specifically designed to receive the seal.

The major drawback of all presently existing seals designed to be located between abutting building surfaces is the inability of such seals to, in a single seal, effectively seal regions between either smooth or rough surfaces.

Thus, there is a present need in the art for a highly effective seal which may be located in a region between abutting building surfaces which are either smooth or rough.

SUMMARY OF THE INVENTION

The present invention is directed to a seal to be placed in the region between abutting building surfaces capable of preventing moisture, dirt, etc., from entering the region between those surfaces. The seal is reversible to accommodate being fitted between either smooth abutting building surfaces or rough abutting building surfaces.

It is an object of the present invention to provide a seal for sealing the region between abutting building surfaces which is usable between either smooth or rough abutting building surfaces, such a seal being provided with recesses for accepting externally applied sealing material where the seal meets rough abutting building surfaces.

It is a further object of the present invention to provide a seal capable of being applied in continuous length in the building joint, especially in cases where the building joint requires the seal to turn corners, or otherwise deviate from linearity.

It is yet another object of the present invention to provide a seal capable of use between either smooth or rough abutting building surfaces which presents, in either case, a relatively smooth face and pleasing aesthetic appearance.

In accordance with these and other objects of the present invention, the seal according to the present invention consists of a first and second surface, each surface being divided into a plurality of face sections. Each face section is separated by an indenting contour disposed in the surface. The outermost face sections at the lateral edges of the second surface are recessed to receive sealant material.

The seal is preferably also formed such that indenting contours in the first surface are joined to the indenting contours of the second surface by interconnecting walls. Further, the seal is preferably provided with a plurality of ridges and grooves in the side faces for accepting sealant material.

The advantages of the present invention, with specific reference to the preferred embodiment, include an improved resistance of the seal to entry of moisture, direct, etc., into the interior region between abutting building surfaces, the ability of the seal to be bent around corners and angles, and provision of an aesthetically pleasing front surface, all in a single, versatile seal. The improved imperviousness is provided by allowing a large amount of sealant material to be introduced between the seal and building surfaces, i.e., the ridges and grooves, and recesses in the face. Provision for bending the seal around corners and bends is made by the shape and material of the seal. The improved aesthetics are provided by allowing the seal, in any configuration, to take on a basically flat front surface. Versatility lies in the fact that the seal disclosed is reversible—providing all the above advantages in a single seal useable between either smooth or rough building surfaces.

The invention will now be further described with reference to the accompanying drawings.

DETAILED DESCRIPTION OF THE PREFERRED EMBODIMENT

Figure 1:
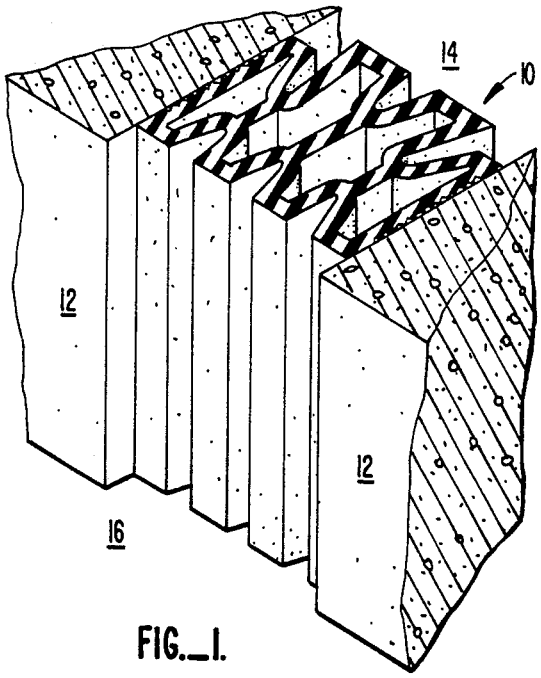
FIG. 1 is a perspective view of a reversible compression seal installed in a building joint according to a preferred embodiment of the present invention.

A general arrangement of a reversible compression seal 10 according to the teachings of the present invention is shown in FIG. 1. The reversible compression seal 10 is shown installed between abutting building surfaces 12, so as to define an inner region 14 and outer region 16.

Figure 2:
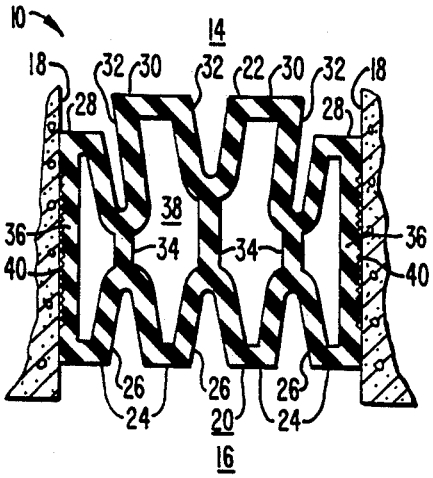
FIG. 2 is a cross-sectional view of a reversible compression seal according to a preferred embodiment of the present invention installed in a region between smooth abutting building surfaces.

FIG. 2 shows in cross-section a reversible compression seal 10 according to the present invention installed between smooth abutting building surfaces 18. Seal 10 includes of first surface 20, in FIG. 2 facing outer region 16, and second surface 22, in FIG. 2 facing inner region 14.

Connecting first surface 20 and second surface 22 are side sections 36. Side sections 36 connect first surface 20 and second surface 22 so as to form a hollow seal body defining a seal body interior 38. Side sections 36 are provided with a plurality of ridges and grooves 40. Ridges and grooves 40 are provided to allow introduction of sealant/adhesive material 42 between side section 36 and building surface 18 (shown in detail in FIG. 3).

First surface 20 is divided into a plurality of face sections 24 separated by indenting contours 26. Face sections 24 are positioned so as to align in a single plane along the surface of seal 10. Second surface 22 is divided into first face sections 28 and second face sections 30, each being separated by an indenting contour 32.

First face sections 28 are located at the outermost lateral edge of second surface 22, in the region where second surface 22 contacts building surface 18. Second face sections 30 are located to the center of second surface 22 from first face sections 28.

First face sections 28 lie in a plane which is recessed relative to the plane of second face sections 30. That is, second face sections 30 protrude out farther from seal body interior 38 than first face sections 28. This recess (i.e., relative positions of first face sections 28 and second face sections 30) allows application of sealant material (not shown in FIG. 2), to improve the imperviousness of the seal provided by reversible compression seal 10, as discussed further below.

Figure 3:
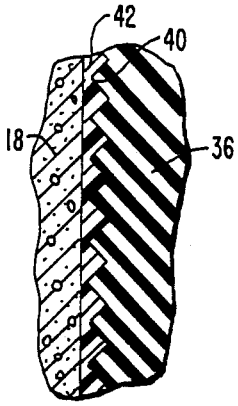
FIG. 3 is a detailed view of a smooth building surface and seal side section having sealant material therebetween.

Indenting contours 26, 32 in first surface 20 and second surface 22, respectively, are directed toward the seal body interior 38—in toward one another. There is an equal number of such indenting contours 26, 32 in each of first surface 20 and second surface 22, and each indenting contour 26 in first surface 20 is positioned opposite a corresponding identical contour 32 in second surface 22. Connecting corresponding contours 26, 32 in first surface 20 and second surface 22, and located in seal body interior 38, are interconnecting walls 34.

Where seal 10 is to be installed between smooth abutting building surfaces 18, as shown in FIG. 2, seal 10 is chosen of a particular width to be, in its relaxed state, slightly larger than the width of the opening between smooth abutting building surfaces 18. Seal 10 is width-wise compressed together and inserted into the opening between smooth abutting building surfaces 18. Reversible compression seal 10 is installed so that first surface 20 faces outer region 16 between smooth abutting building surfaces 18. A continuous bead of sealant/adhesive material 42 is applied at ridges and grooves 40, as shown in FIG. 3, which forms a barrier between the interior region 14 and outer region 16 of the opening between abutting building surfaces 18. A barrier is thus established which prevents the intrusion of moisture, dirt, etc., into the region between smooth abutting building surfaces 18.

Figure 4:
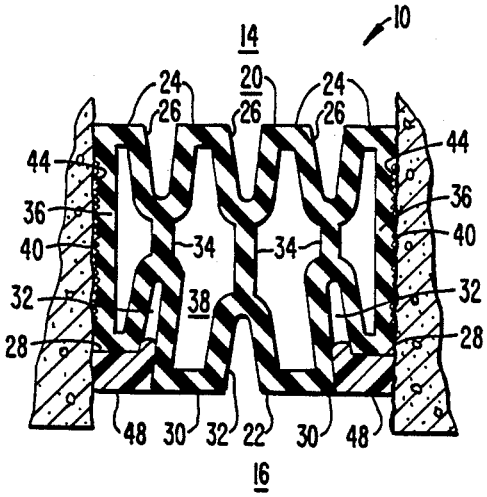
FIG. 4 is a cross-sectional view of a reversible compression seal according to a preferred embodiment of the present invention installed in a region between rough abutting building surfaces.

When seal 10 is to be installed in a region between abutting building surfaces where one or both building surfaces 44 are rough and uneven, as shown in FIG. 4, the seal is reversed in position relative to that previously described so that second surface 22 faces outer region 16 and first surface 20 faces inner region 14. Again, seal 10 is compressed width-wise and installed in the regions between rough abutting building surfaces 44. A sealant-/adhesive material 42 (shown in FIGS. 5(*a*) and 5(*b*)) is applied at ridges and grooves 40 between abutting building surfaces 44 to form a barrier between the inner and outer regions 14, 16 of the area between abutting building surfaces 44. However, due to the irregularity of the abutting building surfaces, it is possible that such a barrier may not fully isolate the inner and outer regions 14, 16 of the space between abutting building surfaces 44, leaving gaps 46 between side surfaces 36 and building surfaces 44 (as shown in FIG. 5(*a*)).

Figure 5A:
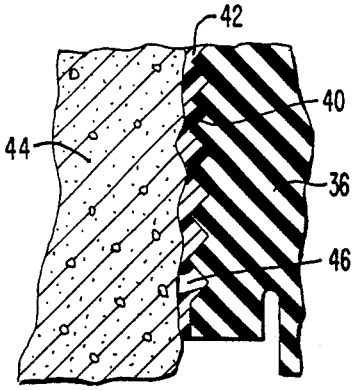
FIGS. 5(*a*) and 5(*b*) are detailed views of a rough building surface and seal side section having sealant therebetween, without and with a sealant bead or fillet where the seal meets the building surface respectively.
Figure 5B:
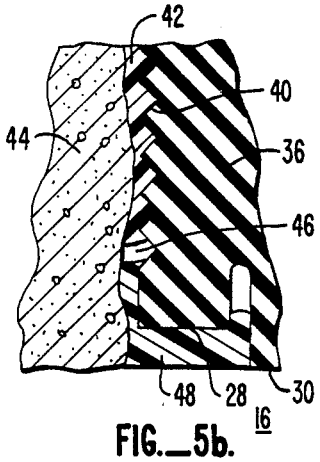

To better avoid the intrusion of moisture and dirt into the inner region 14 a bead or fillet of caulking or externally applied sealant material 48, as shown in FIG. 5, is applied in the region between first face sections 28 and second face sections 30 at the point where first face sections 28 meet abutting building surfaces 44. Sufficient caulking or externally applied sealant material 48 is applied so as to form a smooth surface in the plane defined by second face sections 30. This provides a barrier to moisture and dirt at the outer region 16 which isolates inner and outer regions 14 and 16 even in the event that sealant/adhesive material 42 leaves gaps 46 between side surface 36 and building surface 44.

It should be noted that the application of sealant-/adhesive material 42 and 48 provides an adhesive effect as well as a sealing effect enabling seal 10 to expand and contract in an accordian-like fashion in accordance with movement of abutting building surfaces 18, 44.

Figure 6A:
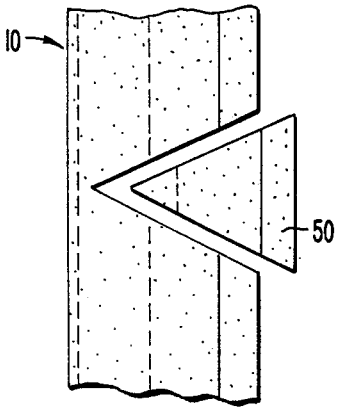
FIGS. 6(*a*) and (*b*) are side views of a reversible compression seal according to the present invention according to a preferred embodiment of the present invention cut for bending, and bent, at 90 degrees, respectively.
Figure 6B:
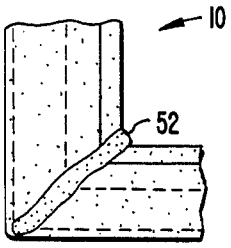
Figure 7:
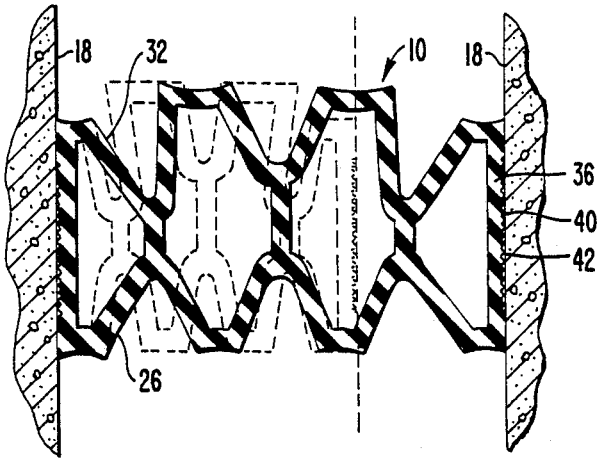
FIG. 7 is a cut-away view of a reversible compression seal according to the present invention in optimal and extended positions.

Accordian-like expansion and contraction of seal 10 is facilitated by indenting contours 26, 32 which may be one or more of a variety of shapes so as to allow expansion and contraction of seal 10. FIG. 7 shows seal 10 in an optional condition (in shadow) and expanded condition (solid lined figure). In its optimal condition seal 10 is compressed slightly from its relaxed condition to provide a tight fit between building surfaces 18 or 44. When the joint between building surfaces 18 or 44 expands due to seismic activity, weather variations, etc., seal 10 likewise expands due to the fact that sealant-/adhesive 42 or 48 secures seal 10 to building surfaces 18 or 44. Thus, an impervious seal is maintained even under variation of the width of the joint.

Where the seal is to be applied in a joint where the abutting building surfaces 18, 44 require the seal to bend at a corner, an installer would cut the seal a depth into the seal body interior 38, as shown in FIG. 6*a*. A section 50 of reversible compression seal 10 is removed to allow reversible compression seal 10 to be bent without crimping. Reversible compression seal 10 is then bent to the appropriate angle and sealant/adhesive material 52 applied to the seal at the cut to rejoin the seal sections, as shown in FIG. 6*b*.

Reversible compression seal 10 may be fabricated of any of a wide variety of polymers and colors in various colors, or similar materials, such as rubber, etc., which may or may not be selectively colored. Preferably, reversible compression seal 10 is manufactured of extruded silicone material, allowing reversible compression seal 10 to be manufactured in continuous lengths capable of resisting longitudinal stretching.

In general, to those skilled in the art to which this invention relates, many changes in construction and widely differing embodiments and applications of the present invention will suggest themselves without departing from its spirit and scope. For example, ridges and grooves 40 may extend either the entire width of side sections 36 or may extend only part-way across side sections 36 leaving smooth regions without ridges and groves where side sections 36 meet first and second surfaces 20, 22. This would provide a region for receiving sealant/adhesive material 42, where the contour of rough building surfaces 44 causes gaps to be formed between the smooth regions of side sections 36 and building surfaces 44 or where additional adhesion between side sections 36 and building surfaces 44 is required. In the case of smooth abutting building surfaces, the smooth regions of side sections 36 would allow a clean crisp corner to be presented where face sections 24 meet smooth abutting building surfaces 18. Thus, the disclosures and descriptions herein are purely illustrative and are not intended to be in any sense limiting.

What is claimed is:

1. A reversible seal for sealing abutting building surfaces, comprising:

a first surface;

a second surface having a plurality of face sections between lateral edges of said second surface such that said face sections define two parallel planes, each said face section separated by an indenting contour disposed in said second surface, a first of said planes closest to said first surface defined by said face sections lying between one of said lateral edges of said second surface and said indenting contour located nearest said same lateral edge, a second of said planes farthest from said first surface defined by said face sections in said second surface other than those said face sections defining said first plane, said first and second planes defining a region for accepting sealant material; and a plurality of side faces joining said first and second surfaces so as to form a longitudinal hollow seal body.

2. The reversible seal according to claim 1, wherein each said indenting contour in said second surface is connected to said first surface by an interconnecting wall.

3. The reversible seal according to claim 1, wherein said side faces are provided with a plurality of ridges and grooves for accepting sealant material.

4. The reversible seal according to claim 1, wherein said indenting contours disposed in said second surface extend toward the center of said hollow seal body.

5. The reversible seal according to claim 4, wherein said first surface is provided with a plurality of flat face sections, each said flat face section separated by an indenting contour disposed in said first surface aligned opposite to and extending in a direction toward said indenting contours disposed in said second surface.

6. The reversible seal according to claim 5, further comprising a plurality of interconnecting walls, each said interconnecting wall interconnecting one of said indenting contours disposed in said second surface with a corresponding one of said indenting contours disposed in said first surface.

7. A reversible seal for sealing abutting building surfaces, comprising:

a first surface having a plurality of face sections, each face section separated by an indenting contour disposed in said first surface;

a second surface having a plurality of face sections between lateral edges of said second face such that said face sections define two parallel planes, each said face section separated by an indenting contour disposed in said second surface, a first of said planes closest to said first surface defined by said face sections lying between one of said lateral edges of said second surfaces and said indenting contour located nearest said same lateral edge, a second of said planes farthest from said first surface defined by said face sections in said second surface other than those said face sections defining said first plane, said first and second planes defining a region for accepting sealant material;

side surfaces joining said first and second surfaces so as to form a longitudinal hollow seal body; and wherein each said first and second surfaces have identical numbers of said indenting contour sections, said indenting contour sections of said second surface opposite in position to said indenting contour sections of said first surface and oriented such that said indenting contour sections in each said first and second surfaces are directed toward the center of said seal body.

8. A reversible seal for sealing abutting building surfaces, comprising:

a first surface having a plurality of slightly concave face sections, each slightly concave face section separated by an indenting contour disposed in said first surface;

a second surface having a plurality of slightly concave face sections between lateral edges of said second face such that said slightly concave face sections define two parallel planes, each said slightly concave face section separated by an indenting contour disposed in said second surface, a first of said planes closest to said first surface defined by said slightly concave face sections lying between one of said lateral edges of said second surface and said indenting contour located nearest said same lateral edge, a second of said planes farthest from said first surface defined by said slightly concave face sections in said second surface other than those said slightly concave face sections defining said first plane, said first and second planes defining a region for accepting sealant material;

side surfaces joining said first and second surfaces so as to form a longitudinal hollow seal body; and wherein each said first and second surfaces have identical numbers of said indenting contour sections, said indenting contour sections of said second surface opposite in position to said indenting contour sections of said first surface and oriented such that said indenting contour sections in each said first and second surfaces are directed toward the center of said seal body.

9. The reversible seal according to claim 8, wherein said side faces are provided with a plurality of ridges and grooves for accepting sealant material.

10. The reversible seal according to claim 8, further comprising a plurality of interconnecting walls, each said interconnecting wall interconnecting one of said indenting contours disposed in said second surface with a corresponding one of said indenting contours disposed in said first surface.

11. A reversible seal for sealing abutting building surfaces, comprising:

a first surface having a plurality of slightly concave face sections, each slightly concave face section separated by an indenting contour disposed in said first surface;

a second surface having a plurality of slightly concave face sections between lateral edges of said second surface such that said slightly concave face sections define two parallel planes, each said slightly concave face section separated by an indenting contour disposed in said second surface, a first of said planes closest to said first surface defined by said slightly concave face sections lying between one of said lateral edges of said second surface and said indenting contour located nearest said same lateral edge, a second of said edges of said second surface and said indenting contour located nearest said same lateral edge, a second of said planes farthest from said first surface defined by said slightly concave face sections in said second surface other than those said slightly concave face sections defining said first plane, said first and second planes defining a region for accepting sealant material;

side surfaces joining said first and second faces so as to form a longitudinal hollow seal body;

each said first and second surfaces having identical numbers of said indenting contour sections, said indenting contour sections of said second surface corresponding in position to said indenting contour sections of said first surface and oriented such that said indenting contour sections in each said first and second surfaces are directed toward the center of said seal body; and a plurality of interconnecting wall sections extending between, and interconnecting, corresponding indenting contour sections of said first and second surfaces, respectively, located within said hollow seal body.

12. The reversible seal according to claim 11, wherein said side faces are provided with a plurality of ridges and grooves for accepting sealant material.

* * * * *